US005443934A

United States Patent [19]

Suzuki et al.

[11] Patent Number: 5,443,934

[45] Date of Patent: Aug. 22, 1995

[54] ELECTROPHOTOGRAPHIC PHOTORECEPTOR

[75] Inventors: Takahiro Suzuki; Seiji Ashiya; Masanori Murase, all of Minami Ashigara, Japan

[73] Assignee: Fuji Xerox Co., Ltd., Tokyo, Japan

[21] Appl. No.: 10,755

[22] Filed: Jan. 29, 1993

[30] Foreign Application Priority Data

Jan. 31, 1992 [JP] Japan ..... 4-040697

[51] Int. Cl.[6] ..... G03G 5/14

[52] U.S. Cl. ..... 430/64; 430/65; 430/60; 430/131

[58] Field of Search ..... 430/64, 60, 131, 65

[56] References Cited

U.S. PATENT DOCUMENTS

| | | | |
|---|---|---|---|
| 4,250,240 | 2/1981 | Shimada et al. | 430/66 |
| 4,464,450 | 8/1984 | Teuscher | 430/60 |
| 5,188,916 | 2/1993 | Hodumi et al. | 430/60 |
| 5,252,422 | 10/1993 | Okano et al. | 430/60 |
| 5,378,566 | 1/1995 | Yu | 430/64 |

FOREIGN PATENT DOCUMENTS

| | | | |
|---|---|---|---|
| 59-223439 | 12/1984 | Japan . | |
| 61-94057 | 5/1986 | Japan . | |
| 61-132958 | 6/1986 | Japan | 430/64 |
| 62-273549 | 1/1987 | Japan . | |
| 62-273553 | 11/1987 | Japan | 430/64 |
| 62-273568 | 11/1987 | Japan | 430/64 |
| 4-124674 | 4/1992 | Japan | 430/131 |

OTHER PUBLICATIONS

Translation of JP 61-132958 (Jun. 1986).

Tokutome et al., "Effect of Solvent Species on the Hydrolysis Behavior of ZR-Butoxide"; Reports of Japan Ceramic Society, 95[5] 578-83 (1989).

*Primary Examiner*—Christopher D. Rodee

*Attorney, Agent, or Firm*—Oliff & Berridge

[57] ABSTRACT

An electrophotographic photoreceptor comprising an electrically conductive substrate having thereon a subbing layer and a photosensitive layer in sequence, wherein the subbing layer is a layer formed by using a hydrolyzable compound, the layer having a residual organic group content of at least 25 mol % based on the total organic group content of the hydrolyzable compound used, or (ii) by coating a solution of the hydrolyzable compound in an organic solvent in which the hydrolyzable compound has been hydrolyzed to a degree of at least 50%. The coating composition exhibits satisfactory film-forming properties to form a subbing layer without causing cracks which thereby provides an electrophotographic photoreceptor with excellent stability on repeated use.

5 Claims, 2 Drawing Sheets

ELECTROPHOTOGRAPHIC PHOTORECEPTOR

FIELD OF THE INVENTION

This invention relates to an electrophotographic photoreceptor comprising an electrically conductive substrate, a subbing layer, and a photosensitive layer. More particularly; it relates to an electrophotographic photoreceptor having an improved subbing layer.

BACKGROUND OF THE INVENTION

With the recent developments of electrophotographic copying machines which can produce copies of various sizes at an increased speed, there has been an increasing demand for a photoreceptor to be used in these electrophotographic copying machines to have higher photosensitivity and longer working life.

Many proposals of so-called separate function type electrophotographic photoreceptors in which a plurality of elements respectively perform functions of a photoreceptor have been made in an attempt to improve various electrophotographic characteristics, such as charge retention, stability on repeated use, light response, spectral characteristics, and mechanical strength.

These electrophotographic photoreceptors are known to have disadvantages, such as (1) poor stability of image contrast against repeated use or environmental changes, (2) liability to cause image defects called white pepper, black pepper, roughness, pinholes, etc., and (3) insufficient durability due to low adhesive strength between a substrate and a photosensitive layer, causing separation of the photosensitive layer during use.

In order to eliminate these disadvantages, it has been proposed to provide a resin subbing layer between a substrate and a photosensitive layer. Resins known for the subbing layer include poly-p-xylene, casein, polyvinyl alcohol, phenolic resins, polyvinyl acetal resins, melamine resins, nitrocellulose, ethylene-acrylic acid copolymers, polyamide resins (e.g., nylon 6, nylon 66, nylon 610, copolymer nylon, and alkoxymethylated nylon), polyurethane, gelatin, polyvinyl pyrrolidone, polyvinylpyridine, and polyvinyl methyl ether.

It has also been proposed to form an intermediate layer using an organozirconium compound, e.g., a zirconium chelate compound or a zirconium alkoxide, or a silane coupling agent as disclosed in JP-A-59-223439 and JP-A-62-273549 (the term "JP-A" as used herein means an "unexamined published Japanese patent application").

What is aimed at by providing a resin subbing layer is to control volume resistance at such a low level that does not deteriorate electrophotographic characteristics by chiefly using a resin having a relatively large content of a polar group. Since volume resistance of a resin has a character of being dependent on ion conduction, it is considerably influenced by temperature and humidity. That is, when a photoreceptor is exposed to a low temperature and low humidity condition or a high temperature and high humidity condition, the resin layer has markedly increased resistance or markedly decreased resistance, respectively. An increased resistance may result in deterioration of electrophotographic characteristics of the photosensitive layer, while a decreased resistance may result in loss of expected functions of the subbing layer.

Thus, it is only part of the above-described disadvantages associated with a photoreceptor that could be overcome by proving a conventional resin layer. Susceptibility to environmental influences being taken into consideration, the effects of the resin layer are reduced by half. Therefore, the conventional resin layers have achieved only insufficient technical improvements.

Where an organozirconium compound, e.g., a zirconium chelate compound or a zirconium alkoxide, or a silane coupling agent is employed as a subbing layer, the above-described problem is considerably settled, and there is obtained an electrophotographic photoreceptor which has reduced dark decay and excellent chargeability, hardly undergoes a reduction in development contrast, has a particularly reduced residual potential, is less subject to variations of electrophotographic characteristics with environmental changes, and is excellent in durability. An electrophotographic photoreceptor of this kind hardly develops image defects, such as white pepper, black pepper, roughness, and pinholes.

However, the problem arising from use of the organozirconium compounds or silane coupling agents is that these compounds have poor film-forming properties and often cause cracks during drying after coating, which gives rise to another cause of image defects.

SUMMARY OF THE INVENTION

An object of this invention is to eliminate the above-mentioned disadvantage of a subbing layer comprising an organozirconium compound and a silane coupling agent and to provide an electrophotographic photoreceptor with excellent electrophotographic characteristics which has an improved subbing layer formed using a hydrolyzable compound.

Another object of the present invention is to provide a method for forming a subbing layer by using a hydrolyzable compound without being accompanied by cracking.

As a result of extensive investigations, the inventors have found that the above objects of the present invention are accomplished by a subbing layer having a specific residual organic group content which is formed using a hydrolyzable compound, such as an organozirconium compound and a silane coupling agent or by a subbing layer formed by coating a coating composition containing a hydrolyzable compound, the hydrolyzable compound having underwent hydrolysis to a certain degree before being coated, and then drying to cure the coated layer. The present invention has been completed based on these findings.

That is, the present invention relates to an electrophotographic photoreceptor comprising an electrically conductive substrate having thereon a subbing layer and a photosensitive layer in sequence, wherein said subbing layer is a layer formed by using a hydrolyzable compound and has a residual organic group content of at least 25 mol % based on the total organic group content of the hydrolyzable compound used (the first embodiment).

The present invention also relates to an electrophotographic photoreceptor comprising an electrically conductive substrate having thereon a subbing layer and a photosensitive layer in sequence, wherein said subbing layer is a layer formed by coating a coating composition comprising a hydrolyzable compound and an organic solvent, said hydrolyzable compound having been hydrolyzed in said organic solvent to a degree of at least 50%, and then curing the coated layer (the second embodiment). In this embodiment, the residual organic group content in the cured subbing layer is preferably at least 25 mol % based on the total organic group content of the hydrolyzable compound used.

The present invention further relates to a method for forming a subbing layer in production of an electrophotographic photoreceptor, comprising preparing a coating composition by mixing a hydrolyzable compound, a solvent capable of dissolving said hydrolyzable compound, and water, coating the coating composition on a substrate, and removing the solvent from the coated layer to cause dehydration-condensation of said hydrolyzable compound to cure (the third embodiment).

DETAILED DESCRIPTION OF THE INVENTION

A residual organic group content in a subbing layer can be expressed in terms of a ratio of the amount (mole number) of the organic group in the subbing layer (for example, an alkoxy group detected as an alcohol or a ligand) as detected by head space gas chromatography to the initial amount (mole number) of the organic group.

Figure 2A:
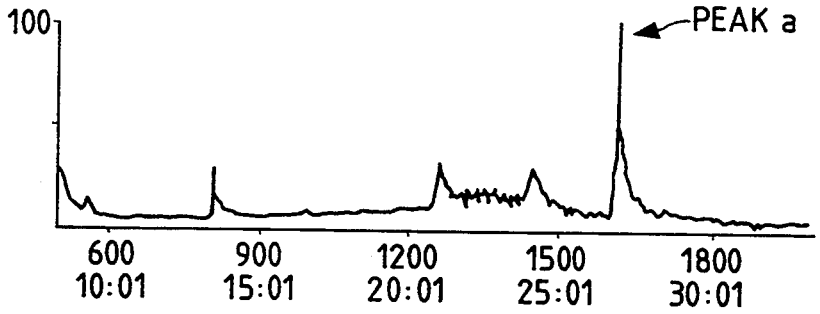
FIG. 2 shows gas chromatograms from which a degree of hydrolysis can be calculated.
Figure 2B:
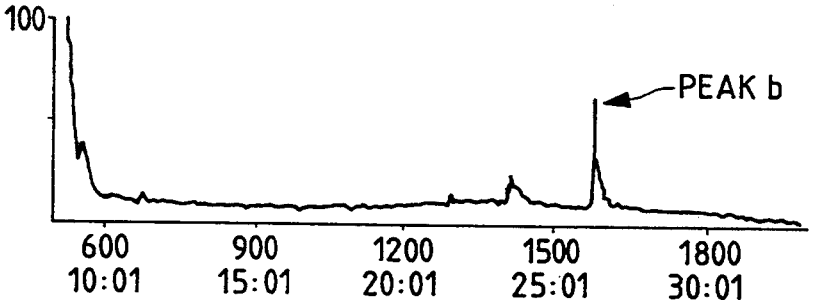
Figure 2C:
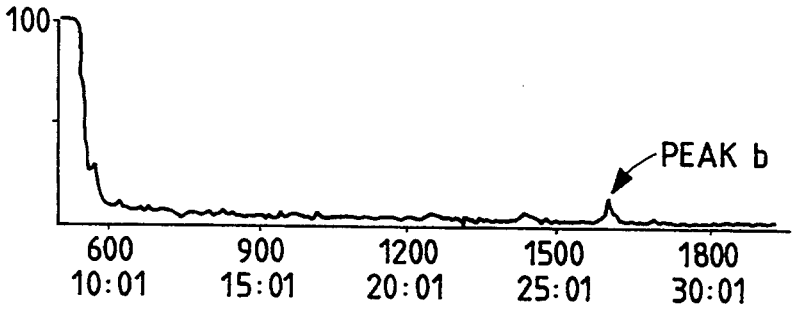
Figure 2D:
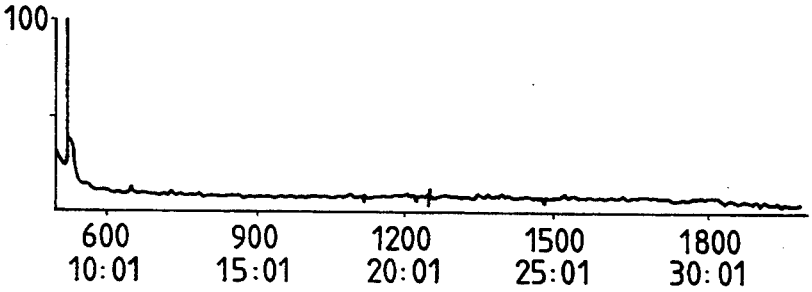

A degree of hydrolysis of a hydrolyzable compound in a solution can be determined from a peak of a gas chromatogram immediately after preparation of the solution (peak a) and that after hydrolysis (peak b) according to equation: $(a-b)/a\times 100$ (%). In FIG. 2(A), (B), (C), and (D) are gas chromatograms of solutions having a degree of hydrolysis of 0%, 39%, 86%, and 100%, respectively.

Figure 1:
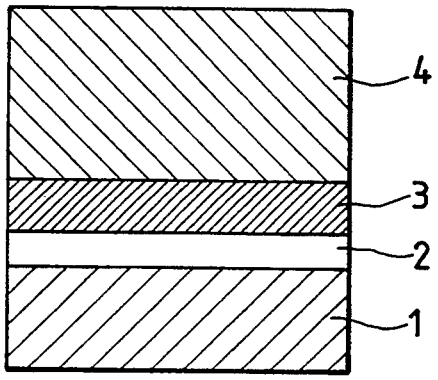
FIG. 1 is a schematic section of an example of the electrophotographic photoreceptor according to the present invention.

In FIG. 1 is shown a schematic cross section of an example of the electrophotographic photoreceptor according to the present invention. Numeral 1 indicates a conductive substrate; 2 a subbing layer; 3 a charge generating layer; and 4 a charge transporting layer.

The conductive substrate which can be used in the present invention is conventional. Examples of suitable materials of substrates are aluminum and stainless steel.

On the conductive substrate is formed a subbing layer using a hydrolyzable compound. The hydrolyzable compound is an organometallic compound having substituents capable of being hydrolyzed upon reaction with water, such as an alkoxy group, chlorine atom and the like. Examples of the hydrolyzable compound include metal alkoxides such as zirconium alkoxides, silane coupling agents, titanate coupling agents, and organic metal chelate compounds such as zirconium chelate compounds. Hydrolyzed products of these compounds have film-forming properties through dehydration-condensation. Of these, silane coupling agents, zirconium alkoxides and zirconium chelate compounds are preferred. The hydrolyzable compound may be used independently or as a mixture thereof. From the standpoint of film-forming properties or adhesiveness, it is particularly preferred that a zirconium alkoxide or a zirconium chelate compound (hereafter collectively referred to as "organozirconium compound") be used together with a silane coupling agent.

In the preferred embodiment, the organozirconium compound and the silane coupling agent are used at a mixing ratio of from 1/1 to 4/1 in terms of a Zr/Si molar ratio. If the Zr ratio is higher than that, the coating composition tends to have reduced adhesion. If the Si ratio is higher than that, the film-forming properties of the coating composition are deteriorated, tending to cause blushing during coating.

The organozirconium compound which can be used in the present invention is represented by formula:

$$(R.O)_n Zr—R'_m$$

wherein R represents an alkyl group preferably having 1 to 5 carbon atoms; R′ represents a residue of acetylacetone, keto ester, amino alcohol, glycol or hydroxy acid; and n and m each represent 0 or an integer of from 1 to 4 , the sum of n and m being 4.

Typical examples of the organozirconium compound are tetrakisacetylacetonatozirconium, tributoxyacetylacetonatozirconium, zirconium tetrabutoxide, zirconium tetraethoxide, and zirconium tetrapropoxide.

The silane coupling agent which can be used in the present invention includes vinyltrichlorosilane, vinyltrimethoxysilane, vinyltriethoxysilane, vinyl-tris(2-methoxyethoxy)silane, vinyltriacetoxysilane, γ-glycidoxypropyl-trimethoxysilane, γ-methacryloxypropyltrimethoxysilane, γ-aminopropyltrimethoxysilane, γ-aminopropyltriethoxysilane,γ-chloropropyltrimethoxysilane, γ-2-aminoethylaminopropyltrimethoxysilane, γ-mercaptopropyltrimethoxysilane, γ-ureidopropyltriethoxysilane, and β-(3,4-epoxycyclohexyl)ethyltrimethoxysilane.

The coating composition for a subbing layer is prepared by dissolving the hydrolyzable compound in an organic solvent capable of dissolving the hydrolyzable compound. In using an organozirconium compound and/or a silane coupling agent as a hydrolyzable compound, examples of suitable solvents are alcohols, e.g., ethanol, methanol, propanol, and butanol; aromatic hydrocarbons, e.g., toluene; and esters, e.g., ethyl acetate and cellosolve acetate; and mixtures thereof. The solvent is generally used in an amount of 1 to 200 parts by weight, preferably 10 to 100 parts by weight, per part by weight of the hydrolyzable compound.

The subbing layer according to the first embodiment of the present invention is a layer formed by coating a solution of a hydrolyzable compound, followed by curing so as to have a residual organic group content of at least 25 mol %, preferably 25 to 50 mol % In the case, the coating solution as prepared may be coated but preferably subjected to hydrolysis to a degree of at least 50% prior to coating.

The subbing layer according to the second embodiment of the present invention is a layer formed by coating a solution of a hydrolyzable compound in an organic solvent capable of dissolving the hydrolyzable compound in which the hydrolyzable compound has been hydrolyzed to a degree of at least 50%, preferably 50 to 95%, more preferably 60 to 95%, followed by curing. In the case, the residual organic group content in the resulting subbing layer is preferably at least 25 mol % based on the total organic group content of the hydrolyzable compound used. If the degree of hydrolysis of the hydrolyzable compound in the coating solution is less than 50%, cracks develop during drying of the coating. If the residual organic group content in the cured subbing layer is less than 25 mol %, the resulting photoreceptor is liable to variation in electrophotographic characteristics with environmental changes or copying cycles.

The coating composition can be subjected to hydrolysis prior to coating by adding water to the solution of a hydrolyzable compound in an organic solvent and allowing the solution to stand under prescribed conditions. The amount of water to be added is selected so as to be less than the amount capable of completely hydrolyzing the hydrolyzable compound, and especially less than the molar amount capable of substituting all the hydrolyzable groups of the hydrolyzable compound. For example, where a hydrolyzable compound has n hydrolyzable groups, water is preferably added in an amount of n/2 mols or more, and less than n mols. The amount of water to be added is generally from about 0.5 to 10% by weight based on the total weight of the coating solution. After addition of water, the coating solution is preferably allowed to stand for, e.g., 1 day to 1 week at, e.g., 50 to 70% RH.

The previous hydrolysis may also be effected, without addition of water, by allowing the coating composition to stand in the open air or under a humid condition of 50 to 80 RH (relative humidity) for 1 day to 1 week.

Coating can be carried out by any of known techniques, such as dip coating, spray coating, blade coating, spinner coating, bead coating, and curtain coating.

The coating is then dried at a temperature of from 100° to 200° C., and preferably 135° to 170° C., for a period of from 5 minutes to 6 hours, and preferably from 5 minutes to 2 hours, in an air flow or in still air. The drying conditions should be selected in the first embodiment so that the residual organic group content in the cured subbing layer is 25 mol % or more.

The heat curing of the subbing layer may be performed either immediately after coating or simultaneously with heating for curing of a photosensitive layer formed thereon.

The thickness of the subbing layer is usually set between 0.01 μm and 5 μm, and preferably between 0.1 μm and 1 μm.

A photosensitive layer is then formed on the thus formed subbing layer. The photosensitive layer may have either a single-layer structure or a laminate structure. A photosensitive layer of single-layer structure includes a dye-sensitized ZnO photosensitive layer or CdS photosensitive layer and a photosensitive layer comprising a charge transporting substance having dispersed therein a charge generating substance, etc.

A photosensitive layer of laminate structure includes a combination of a charge generating layer generally having a thickness of 0.01 to 5 μm, preferably 0.5 to 3 μm and a charge transporting layer generally having a thickness of 5 to 100 μm, preferably 10 to 50 μm, each of which performs the respective function. The order of laminating these layers is arbitrary.

The charge generating layer comprises a charge generating substance and, if desired, an appropriate binder resin. Examples of suitable charge generating substances include selenium and selenium alloys; inorganic photoconductive substances, e.g., CdS, CdSe, CdSSe, ZnO, and ZnS; metallo- or metal-free phthalocyanine pigments; azo pigments, such as bisazo pigments and trisazo pigments; squarylium compounds; azulenium compounds; perylene pigments; indigo pigments; quinacridone pigments, polycyclic quinone pigments; cyanine dyes; xanthene dyes; charge transfer complexes composed of poly-N-vinylcarbazole and trinitrofluorenone, etc.; and eutectic complexes composed of a pyrylium salt dye and a polycarbonate resin, etc.

Binder resins which may be used in the charge generating layer are conventional and include polycarbonate, polystyrene, polyvinyl butyral, methacrylic ester homo- or copolymers, vinyl acetate homo- or copolymers, cellulose esters or ethers, polybutadiene, polyurethane, and epoxy resins.

The charge transporting layer is formed mainly from a charge transporting substance. The charge transporting substance to be used is not particularly limited as long as it transmits visible light and is capable of transporting charges. Specific examples are imidazole, pyrazoline, thiazole, oxadiazole, oxazole, hydrazone, ketazine, azine, carbazole, polyvinylcarbazole, etc. and derivatives of these compounds; triphenylamine derivatives, stilbene derivatives, and benzidine derivatives. If desired, a binder resin is used in combination. Examples of suitable binder resins are polycarbonate, polyarylate, polyester, polystyrene, styrene-acrylonitrile copolymers, polysulfone, polymethacrylic esters, and styrene-methacrylic ester copolymers.

The present invention is now illustrated in greater detail with reference to Examples, but it should be understood that the present invention is not construed as being limited thereto. All the parts, percents, and ratios are by weight unless otherwise indicated.

EXAMPLE 1

Formation of Subbing Layer:

| | |
|---|---|
| Tetrakisacetylacetonatozirconium ("ZC 150" produced by Matsumoto Kosho K.K.) | 20 parts |
| γ-Methacryloxypropyltrimethoxysilane ("KBM 503" produced by Shin-Etsu Chemical Industry Co., Ltd.) | 10 parts |
| Methyl alcohol | 400 parts |
| n-Butyl alcohol | 100 parts |
| n-Amyl alcohol | 200 parts |

The above components were stirred in a stirrer to prepare a coating composition for a subbing layer. To the composition was added 5% of water based on the total weight of the composition. Gas chromatograms obtained before and after the addition of wailer revealed a degree of hydrolysis of 60%. The composition was coated on the surface of an aluminum cylinder having a diameter of 85 mm by dip coating, air-dried for about 5 minutes, and then heat-dried at 150° C. for 10 minutes to form a subbing layer having a thickness of about 0.2 μm.

As a result of head space gas chromatography of the subbing layer (heating conditions: 180° C.×2 hrs), it was found that about 30% of the initial organic group remained. The surface of the subbing layer was observed under an optical microscope to see any cracks. The result of the observation is shown in Table 2 below.

Formation of Charge Generating Layer:

A solution of 87 parts of particulate trigonal selenium and 13 parts of a vinyl chloride-vinyl acetate copolymer ("Solution Vinyl VMCH" produced by Union Carbide) in 200 parts of n-butyl acetate was dispersed in an attritor for 24 hours. To 30 parts of the resulting dispersion was added 57 parts of n-butyl acetate for dilution to prepare a dip coating composition.

The aluminum cylinder with the subbing layer on it was then dip-coated with the coating composition and dried at 100° C. for 5 minutes to form a charge generating layer having a thickness of about 0.1 μm.

Formation of Charge Transporting Layer:

Ten parts of N,N'-diphenyl-N,N'-bis(3-methylphenyl)[1,1'-biphenyl]-4,4'-diamine and 10 parts of polycarbonate Z resin were dissolved in 80 parts of monochlorobenzene to prepare a coating composition for a charge transporting layer. The composition was coated on the charge generating layer and dried in hot air at 100° C. for 60 minutes to form a 25-μm thick charge transporting layer.

The thus obtained electrophotographic photoreceptor was mounted on an EC scanner, and a running test was carried on up to 30000 cycles. Changes in charged potential (DDP) and residual potential (RP) between the initial stage and the stage after 30000 cycles were measured, and the results (ΔDDP and ΔRP) obtained are shown in Table 2.

EXAMPLES 2 TO 4 AND COMPARATIVE EXAMPLES 1 TO 4

An electrophotographic photoreceptor was prepared in the same manner as in Example 1, except that the subbing layer was formed under the conditions shown in Table 1 below. The resulting photoreceptor was evaluated in the same manner as in Example 1. The results obtained are shown in Table 2.

TABLE 1

| Example No. | Subbing Layer-Forming Material: Zr Compound | Subbing Layer-Forming Material: Si Compound | Solvent | Method of Hydrolysis | Degree of Hydrolysis (%) | Drying Conditions | Residual Organic Group Content (%) |
|---|---|---|---|---|---|---|---|
| Example 1 | tetrakisacetylacetonatozirconium | γ-methacryloxypropyltrimethoxysilane | methanol n-butanol n-amyl alcohol | addition of water | 60 | 150° C. × 10 mins | 30 |
| Example 2 | tributoxyacetylacetonatozirconium | γ-aminopropyltrimethoxysilane | ethanol n-butanol | 4 days' stirring in open system | 70 | 150° C. × 7 mins | 25 |
| Example 3 | tributoxyacetylacetonatozirconium | — | n-propanol n-butanol | addition of water | 50 | 135° C. × 10 mins | 40 |
| Example 4 | zirconium tetrabutoxide | γ-methacryloxypropyltrimethoxysilane | methanol n-butanol | 1 day's standing | 50 | 100° C. × 5 mins | 30 |
| Compara. Example 1 | tetrakisacetylacetonatozirconium | γ-methacryloxypropyltrimethoxysilane | methanol n-butanol n-amyl alcohol | none | 0 | 150° C. × 10 mins | 50 |
| Compara. Example 2 | tributoxyacetylacetonatozirconium | γ-aminopropyltrimethoxysilane | ethanol n-butanol | 1 day's stirring in open system | 30 | 150° C. × 7 mins | 40 |
| Compara. Example 3 | tributoxyacetylacetonatozirconium | — | isopropanol n-butanol | none | 20 | 135° C. × 15 mins | 20 |
| Compara. Example 4 | zirconium tetrabutoxide | γ-methacryloxypropyltrimethoxysilane | ethanol n-butanol | none | 40 | 150° C. × 10 mins | 5 |

TABLE 2

| Example No. | Cracks of Subbing Layer | EC Cycle Characteristics: ΔDDP | EC Cycle Characteristics: ΔRP |
|---|---|---|---|
| Example 1 | not observed | −5 | −30 |
| Example 2 | " | +1 | −20 |
| Example 3 | " | −3 | −25 |
| Example 4 | " | 0 | −20 |
| Compara. Example 1 | observed | −2 | −20 |
| Compara. Example 2 | " | 0 | −30 |
| Compara. Example 3 | " | +10 | +10 |
| Compara. Example 4 | " | +15 | +20 |

As described and demonstrated above, the subbing layer according to the present invention involves no drawbacks, such as cracks, to provide an electrophotographic photoreceptor which enjoys advantages of a subbing layer formed by using an organozirconium compound or a silane coupling agent. Therefore, the electrophotographic photoreceptor of the present invention exhibits excellent durability and is less subject to deteriorations on repeated use, such as variations in charged potential and an increase in residual potential, to provide images of high quality, freed from defects, such as white pepper, black pepper, roughness and pinhole, for an extended period of time.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive substrate having thereon a subbing layer and a photosensitive layer in sequence, wherein said subbing layer is a layer formed by coating a coating composition comprising hydrolyzable compounds and an organic solvent, said hydrolyzable compounds having been hydrolyzed in said organic solvent to a degree of 50% to 95% and then cured, wherein said hydrolyzable compounds comprise a hydrolyzable zirconium chelate or zirconium alkoxide and a hydrolyzable silane coupling agent.

2. An electrophotographic photoreceptor as claimed in claim 1 wherein said subbing layer is a cured layer having a residual organic group content of at least 25 mol. % based on the total organic group content of the hydrolyzable compounds used.

3. An electrophotographic photoreceptor as claimed in claim 1, wherein said subbing layer has a residual organic group content of 25–50 mol. % based on the total organic group content of the hydrolyzable compounds used.

4. An electrophotographic photoreceptor as claimed in claim 1, wherein said hydrolyzable compound has been hydrolyzed to a degree of 60 to 95%.

5. An electrophotographic photoreceptor as claimed in claim 1, wherein said hydrolyzable compounds has been hydrolyzed to a degree of 50 to 70%.

* * * * *